United States Patent [19]

Molnar et al.

[11] 4,162,899

[45] Jul. 31, 1979

[54] POLISHING FOIL OR POLISHING PLATE

[75] Inventors: Sandor Molnar, Neuhausen; Wolfhart Rieger, Buch, both of Switzerland

[73] Assignee: Swiss Aluminium Ltd., Chippis, Switzerland

[21] Appl. No.: 824,561

[22] Filed: Aug. 15, 1977

[30] Foreign Application Priority Data

Sep. 8, 1976 [CH] Switzerland ..... 11380/76

[51] Int. Cl.[2] ..... B24D 11/02

[52] U.S. Cl. ..... 51/295; 51/309; 51/401; 41/407

[58] Field of Search ..... 51/295, 298, 293, 309, 51/204, 401, 407

[56] References Cited

U.S. PATENT DOCUMENTS

| | | | |
|---|---|---|---|
| 2,595,733 | 5/1952 | Tone et al. | 51/298 |
| 2,937,934 | 5/1960 | Nefflen | 51/298 |
| 3,214,253 | 10/1965 | McCord | 51/295 |
| 3,249,410 | 5/1966 | Lorenzo et al. | 51/309 |
| 3,284,178 | 11/1966 | Timmer et al. | 51/297 |
| 3,343,932 | 9/1967 | Juillerat | 51/309 |
| 3,398,442 | 8/1968 | Palmer | 51/309 |
| 3,860,400 | 1/1975 | Prowse et al. | 51/295 |
| 3,985,521 | 10/1976 | Borchard et al. | 51/295 |
| 4,063,909 | 12/1977 | Mitchell | 51/295 |

*Primary Examiner*—Donald J. Arnold
*Attorney, Agent, or Firm*—Robert H. Bachman

[57] ABSTRACT

A polishing foil or plate is made up of a metallic base provided with a non-metallic layer which covers the polishing surface, acts as a polishing substrate and is intimately bonded to the metallic base. Used together with polishing substances, the polishing foil or plate prepares material such as metals, minerals and ceramics for microscopic examination and does so employing the minimum of polishing substance and with the minimum of rounding at the edge of the samples.

9 Claims, 2 Drawing Figures

POLISHING FOIL OR POLISHING PLATE

Figure 1:
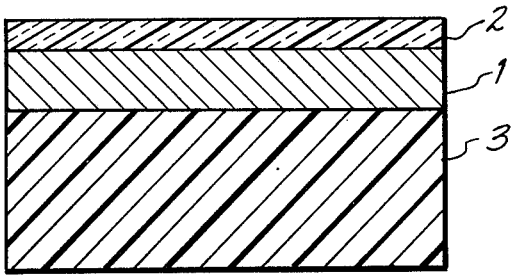

The invention concerns a polishing foil or plate which is used together with a polishing substance for preparing the surfaces of materials, in particular for polishing metallographic, petrographic and ceramographic samples.

Samples of metals, minerals or ceramics are prepared for microscopic examination by grinding and then polishing, the latter with the help of a polishing substance such as diamond, $Al_2O_3$, MgO etc. Polishing in this sense means smoothing the surface of the sample to be examined with hard materials of particle size $\leqq 10\ \mu m$.

For the polishing process it is normal to apply a polishing substance to a polishing substrate before starting to polish, or the polishing substance is applied to the polishing substrate, for example in the form of an aqueous suspension, during the polishing process.

A range of polishing substrate materials (such as woven and fibrous polishing cloths, plastic discs with grooved or porous surfaces, compact plastic plates and steel mesh) is known and available for the wide variety of materials which have to be prepared, and also for the standard of finish and polishing material.

In order to remove a large amount of material using a given quantity of polishing agent, it is necessary that the cutting effect of the particles e.g. of diamond should last as long as possible. To this end the particles must be anchored in position but not too deeply impressed into the polishing substrate, otherwise they will not provide the desired cutting effect. The polishing cloths used up to now consist of a substrate layer which fixes the position or the grains, is usually fibrous and porous and is set on another substrate or base which is impermeable to both the polishing grains and to liquids.

Compact polishing plates (usually rotating discs known as "wheels") have on the other hand a hard metallic or plastic surface with pores which engage the grains and push them round with the wheel, or the surface is sufficiently ductile that it is possible for the grains to become partly embedded in the metal or plastic matrix.

The disadvantages of the polishing substrates known and employed up to now can be summarized as follows:

On polishing samples of hard materials the polishing operation consumes large amounts of the polishing substance which becomes worked into the surface of the cloth, disc or wheel, with the result that only a small part of the amount applied contributes to the polishing operation.

In the case of samples which have been embedded or mounted in plastic, the embedding material is subjected to extensive wear which, in particular with soft, structured cloths, is more pronounced than the wear on the sample. The resultant rounding of the sample is undesirable, especially when wishing to examine the regions near the edge of the sample.

Plastic polishing wheels and plastic polishing substrates which give better polishing performance than cloths, especially with hard materials, are expensive. Their polishing capacity which is initially good becomes rapidly poorer however as a result of the accumulation of dirt. Regeneration of the polishing substrate is laborious and expensive.

The polishing substrates which are known at present can not be used for a number of materials made up of several layers.

The object of the invention is therefore to produce a polishing foil or plate (hereinafter denoted only as a polishing plate), which is able to ensure optimum polishing results, at the same time consuming the minimum of polishing substance and with the minimum of edge rounding, and which can also polish hard materials made up of a plurality of layers.

This object is achieved by way of the invention in which a metallic base is provided with a non-metallic layer which acts as a polishing substrate, covers the polishing surface and is intimately bonded to the metallic base.

By metallic base is to be understood the metal layer which carries the non-metallic layer which serves as the polishing substrate. The said metallic layer is, depending on the type of polishing plate desired, from several hundred angstroms to some centimeters thick.

Any metal, the surface of which can be provided with a non-metallic layer by chemical, electrochemical or physical means, can be employed for the metallic base. It is made preferably from one of the metals of the group: aluminium, zinc and iron, whereby both the pure metal and the alloys of these metals are included in this choice.

The metallic base is preferably in the form of foil or sheet (plate). To achieve specific properties however the base can be produced by suitable chemical or physical processes e.g. by evaporating, electrolytic or non-electrical deposition etc. on to another base. This other base could for example be metallic foil, sheet or plate, or foil and plate of a suitable plastic.

In a preferred version the metallic base consists of a foil which is bonded to a plastic foil in order to increase the mechanical stability, at the same time maintaining the flexibility. In a further version the foil is made self-adhesive for bonding to the polishing wheel.

Preferred non-metallic layers are anodically or chemically produced oxide, phosphate, chromate, molybdate or oxalate layers. The polishing plate of the invention exhibits significant advantages over the classical polishing cloths and plates viz.

- The amount of time required to achieve comparable results is shortened.
- In the case of hard materials (e.g. ceramics) the number of steps required is reduced and, correspondingly the number of pieces of equipment required is also reduced.
- The outlay of consumable materials, in particular for polishing substances is considerably reduced.
- Because no deformation occurs in the polishing plate of the invention, the samples can be polished without problem with perfectly flat surfaces right up to their edges.

Just as conventional polishing cloths, discs and plates require matching of the polishing substance and the sample, with the polishing plate of the invention the type of substrate, the metallic base, the non-metallic layer and the thicknesses of these are chosen in keeping with the requirements of the sample to be polished.

Referring to the drawings,

FIG. 1 shows the metallic base 1 with a non-metallic layer 2. The metallic base is deposited on another base or support 3. As an example, aluminum 1 is evaporated on to a polishing disc 3, and by means of anodic oxidation the non-metallic layer 2 is produced.

Figure 2:
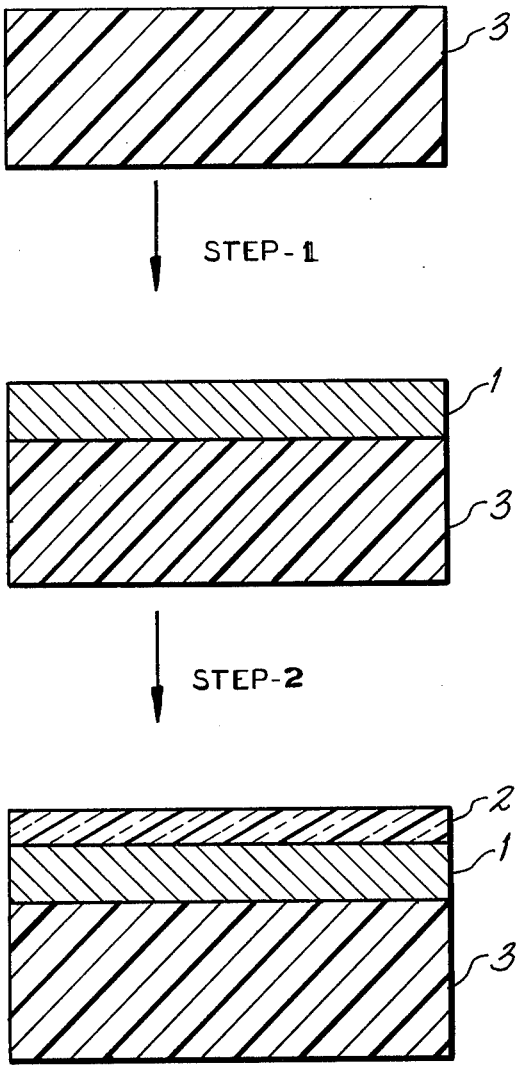

FIG. 2 shows a two-step procedure wherein a metallic base with a non-metallic layer is attached to another base or support. In accordance with step 1, metallic base 1 is deposited on support base 3 by any of the methods disclosed in the present application. Step 2 shows non-metallic layer 2 produced on the metallic base 1 by chemical, electrochemical or physical means.

The following examples describe the application of the invention and the advantages it offers:

EXAMPLE 1

5 aluminium oxide ceramic samples each 6.5 mm in diameter, were mounted in the normal manner by embedding in an acrylic resin and subjected to wet grinding with particle sizes 120, 240 and 400 for subsequent polishing.

For comparison purposes polishing with 0.25 μm diamond paste on the following substrates was carried out:

Grooved plastic disc
Fibrous PVC plastic
Porous plastic disc
Steel mesh
Polishing plate in accordance with the invention The polishing plate of the invention was made up of a 50 μm thick aluminium foil as metallic base, bonded to a 190 μm thick plastic foil as the second base.

The non-metallic layer was a 0.35 μm thick aluminium oxide layer produced by anodic oxidation. The anodic oxidation was carried out at room temperature in an aqueous electrolyte containing 210 g/l sulphuric acid and using a voltage of 17 V and current density of 1.5 A/dm$^2$.

The substrates were stuck on to the wheel of a conventional polishing device and prepared with a preweighed quantity of diamond paste. During the polishing process a commercially available lubricant was allowed to drip onto the substrate.

After one hour of polishing, the samples were cleaned and the surface finish examined under the microscope. Samples which were not finished after that hour of polishing were polished for a further two hours and if necessary additional, weighed amounts of diamond paste applied.

Table No. 1 shows in a summarized form the microscopical assessment of the polished surface and the quantity of diamond paste required for the preparation of the substrate.

Table 1

| Polishing substrate | Diamond paste (g) | Assessment after 1 hour | Assessment after 3 hours |
|---|---|---|---|
| Grooved plastic disc | 0.7 | slight polishing effect | polished to approx. 60% |
| Fibrous PVC-plastic | 0.8 | slight polishing effect | polished to approx. 60% |
| Porous plastic disc | 0,15 | definite polishing effect | polished to approx. 60% |
| Steel mesh | 0.8 | polishing completed, definite traces of polishing | |
| Polishing substrate of the invention | 0.05 | polishing completed, no traces of polishing | |

EXAMPLE 2

A sample of a surface treated 50 CrV 4 spring steel, which had a Vickers hardness of 620 kp/mm$^2$ was mounted in acrylic resin and prepared by wet grinding for subsequent polishing.

The polishing plate comprised a 0.1 mm thick aluminium foil which had been provided with a 3 μm thick molybdate layer and had been adhesively bonded to a 0.5 mm thick plastic foil.

The molybdate layer was produced by a conventional two-step process:

1$^{st}$ Step:

Activation of the aluminium foil in a solution of the following composition and at room temperature:

Zinc oxide: 20 g/l
Sodium hydroxide: 120 g/l
Potassium-sodium-tartrate: 50 g/l
Iron-III-chloride: 2 g/l
Sodium nitrate: 1 g/l 2$^{nd}$ Step:

Deposition of the molybdate layer in 3.5 min. in a solution of the following composition and at room temperature:

Ammonium heptamolybdate: 50 g/l
Ammonium borofluoride: 15 g/l
Triethanolamine: 60 g/l The polishing plate was stuck down onto the polishing wheel used in example No. 1 and provided with 0.25 μm diamond paste before starting to polish. A commercially available lubricant was dripped continuously onto the polishing surface during the polishing operation.

After 1½ hours the surface to be examined had been polished perfectly flat right up to the edges and with almost no signs of scratches.

What we claim is:

1. A polishing foil or polishing plate which is used together with a polishing substance for preparing the surfaces of materials, in particular for polishing metallographic, petrographic and ceramographic samples which comprises a first layer of a metallic base having a polishing surface provided with a second non-metallic layer selected from the group consisting of an inorganic oxide, inorganic phosphate, inorganic chromate, inorganic molybdate and inorganic oxalate layers which covers the polishing surface, acts as a polishing substrate and is intimately and directly bonded to the said metallic base without the presence of an intermediate layer therebetween.

2. A polishing plate according to claim 1 in which the metallic base is in the form of a foil adhesively bonded to a third layer of a plastic foil support base on the side opposite said second layer.

3. A polishing plate according to claim 1 in which the metallic base is aluminum.

4. A polishing plate according to claim 3 in which the non-metallic layer is a natural metal oxide layer on said first layer.

5. A polishing plate according to claim 1 in which the metallic base is a metal selected from the group consisting of zinc and steel.

6. A polishing plate according to claim 3 in which the non-metallic layer is a phosphate layer.

7. A polishing plate according to claim 3 in which the non-metallic layer is a chromate layer.

8. A polishing plate according to claim 3 in which the non-metallic layer is an oxalate layer.

9. A polishing plate according to claim 3 in which the non-metallic layer is a molybdate layer.

* * * * *